US011291895B2

(12) United States Patent
Travers

(10) Patent No.: US 11,291,895 B2
(45) Date of Patent: Apr. 5, 2022

(54) SYSTEM, APPARATUS, AND METHOD FOR STORING EQUIPMENT

(71) Applicant: Platypus Golf Company LLC, Tampa, FL (US)

(72) Inventor: Thomas Travers, Tampa, FL (US)

(73) Assignee: Platypus Golf Company LLC, Tampa, FL (US)

( * ) Notice: Subject to any disclaimer, the term of this patent is extended or adjusted under 35 U.S.C. 154(b) by 0 days.

(21) Appl. No.: 17/313,794

(22) Filed: May 6, 2021

(65) Prior Publication Data

US 2022/0016502 A1 Jan. 20, 2022

Related U.S. Application Data

(60) Provisional application No. 63/052,585, filed on Jul. 16, 2020.

(51) Int. Cl.
*A63B 55/00* (2015.01)
*A63B 71/14* (2006.01)

(52) U.S. Cl.
CPC ..... *A63B 55/408* (2015.10); *A63B 71/146* (2013.01)

(58) Field of Classification Search
CPC ..... A63B 55/408; A63B 71/146; A45C 11/00
See application file for complete search history.

(56) References Cited

U.S. PATENT DOCUMENTS 3,062,422 A * 11/1962 Lord ..... A63B 47/04 206/579
3,133,682 A * 5/1964 Sawyer ..... D06F 59/04 223/78
4,061,170 A * 12/1977 Marks ..... A45C 11/00 206/278
4,565,287 A * 1/1986 Rede ..... A63B 71/146 223/78
5,642,809 A * 7/1997 Mayville ..... A45C 11/24 206/278

(Continued)

FOREIGN PATENT DOCUMENTS

JP 2005-179858 7/2005
KR 20110024340 A 3/2011

OTHER PUBLICATIONS

Amazon.com page (https://www.amazon.com/ORNOOU-Gloves-Stretcher-Support-Accessories/dp/B08MTWZSMM/ref=sr_1_9?dchild=1&keywords=golf+glove+shaper&qid=1617889604&sr=8-9) visited Apr. 8, 2021 for ORNOOU glove stretcher.

(Continued)

*Primary Examiner* — Eugene L Kim
*Assistant Examiner* — Christopher Glenn
(74) *Attorney, Agent, or Firm* — Stephen L. Keefe LLC

(57) ABSTRACT

An apparatus for storing equipment is disclosed. The apparatus has a housing including a plurality of members configured to rotate relative to each other, about an attachment portion of the plurality of members, between a closed position forming an interior cavity and an open position, an assembly attached to the housing and configured to rotate relative to the housing, a shaping member attached to one of the plurality of members and configured to rotate relative to the one of the plurality of members, and at least one aperture extending through the one of the plurality of members. The shaping member is configured to removably receive the equipment.

20 Claims, 9 Drawing Sheets

(56) References Cited

U.S. PATENT DOCUMENTS

| | | | | |
|---|---|---|---|---|
| 5,996,116 | A * | 12/1999 | Tate | A63B 57/207 2/200.1 |
| 6,250,470 | B1 * | 6/2001 | Mackenzie | A01K 97/08 206/315.11 |
| 6,454,097 | B1 * | 9/2002 | Blanco | A61F 17/00 206/570 |
| 6,766,591 | B1 * | 7/2004 | McKinney | D06F 59/02 34/106 |
| 7,162,748 | B2 * | 1/2007 | Hottner | A41D 19/015 442/289 |
| 7,770,723 | B2 * | 8/2010 | Hajduk | D06F 59/04 223/78 |
| D640,434 | S * | 6/2011 | Krautner | D32/59 |
| D655,878 | S | 3/2012 | Hajduk | |
| 8,967,397 | B1 * | 3/2015 | Greenwald | A63B 1/0036 211/85.7 |
| 2008/0105571 | A1 * | 5/2008 | Hajduk | D06F 59/04 206/231 |
| 2012/0012624 | A1 * | 1/2012 | Marrero | A63B 57/203 224/660 |
| 2018/0249800 | A1 * | 9/2018 | Neill | F42B 39/26 |

OTHER PUBLICATIONS

Glovelast page (https://glovelastgolf.com/) visited Apr. 8, 2021 for Glovelast glover shapers.

Stripebird page (https://stripebird.com/products/performance-gloves-case) visited Apr. 8, 2021 for Stripebird Performance Gloves Case.

International Search Report and Written Opinion dated Oct. 21, 2021, in counterpart international application No. PCT/US21/41214.

* cited by examiner

SYSTEM, APPARATUS, AND METHOD FOR STORING EQUIPMENT

RELATED APPLICATIONS

This application claims the benefit of U.S. Provisional Patent Application No. 63/052,585 filed on Jul. 16, 2020, which is hereby incorporated by reference in its entirety.

TECHNICAL FIELD

The present disclosure generally relates to a system, apparatus, and method for equipment, and more particularly to a system, apparatus, and method for storing equipment.

BACKGROUND

Recreational activities such as golf typically involve the organization of materials used by an individual participating in the activity. For example, a typical golfer uses between five and seven different items, in addition to golf clubs, to effectively play a round of golf. Golfers usually scatter these items throughout their golf bags. These items may include equipment and devices such as golf tees, divot repair tools, ball markers, gloves, yardage books, and golf balls, which are typically stored non-systematically in random pockets of a golf bag. It can be time-consuming and frustrating for a golfer to attempt to find and organize these items at various points during a golf game, such as before his or her first tee shot. The typical golfer will usually place these items in the most convenient pocket or pockets of a golf bag without much thought, and will typically have difficulty remembering where the various items were placed in between rounds of golf.

Golfers usually experience difficulties in handling and caring for golf gloves during play for similar reasons as set forth above. For example, golfers experience difficulty in the breakdown and storage of gloves in between rounds of golf and between practice sessions or games. Because conventional methods do not offer a systematic way for organizing golf items before and after a round of golf, golfers typically are not able to properly maintain and care for their gloves. For example, a typical golfer often bunches a glove up in a pocket or uses the glove as storage for other items mentioned above, which ultimately stretches out the glove. Also for example, the typical golfer often adheres or attaches the glove to the outside of a bag, which exposes the glove to outdoor elements and increases a probability of losing the glove. As a result, gloves are not typically maintained in good condition, which leads to the gloves wearing out or breaking down relatively quickly and the golfer spending additional money to purchase new or additional golf gloves relatively often based on the gloves not being properly maintained.

U.S. Pat. No. 7,770,723 issued to Hajduk (the '723 patent) attempts to address some of the above shortcomings in the prior art by providing a moisture absorbing glove form that may be inserted into a glove. However, the container of the moisture absorbing glove form of the '723 patent presents a user with an additional item that is to be managed and maintained, adding an additional burden to the user for organizing items. Further, the container of the '723 patent does not provide for organization of additional items used during an activity such as golf.

The exemplary disclosed apparatus, system, and method of the present disclosure are directed to overcoming one or more of the shortcomings set forth above and/or other deficiencies in existing technology.

SUMMARY OF THE DISCLOSURE

In one exemplary aspect, the present disclosure is directed to an apparatus for storing equipment. The apparatus includes a housing including a plurality of members configured to rotate relative to each other, about an attachment portion of the plurality of members, between a closed position forming an interior cavity and an open position, an assembly attached to the housing and configured to rotate relative to the housing, a shaping member attached to one of the plurality of members and configured to rotate relative to the one of the plurality of members, and at least one aperture extending through the one of the plurality of members. The shaping member is configured to removably receive the equipment.

In another aspect, the present disclosure is directed to a method for storing equipment. The method includes providing a first member, providing a second member attached to the first member via an attachment portion, the second member including a plurality of apertures, rotating the first member and the second member relative to each other about the attachment portion between a closed position forming an interior cavity and an open position, providing an organizational assembly attached to the attachment portion or the first member, and rotating the organizational assembly about the attachment portion or about a first axis parallel to the attachment portion. The method also includes providing a shaping member rotatably attached to the second member, rotating the shaping member about a second axis that is substantially perpendicular to the attachment portion or the first axis, placing a piece of the equipment on the shaping member, and drying the piece of the equipment when it is placed on the shaping member in the interior cavity via the plurality of apertures when the first member and the second member are in the closed position.

DETAILED DESCRIPTION AND INDUSTRIAL APPLICABILITY

Figure 1:
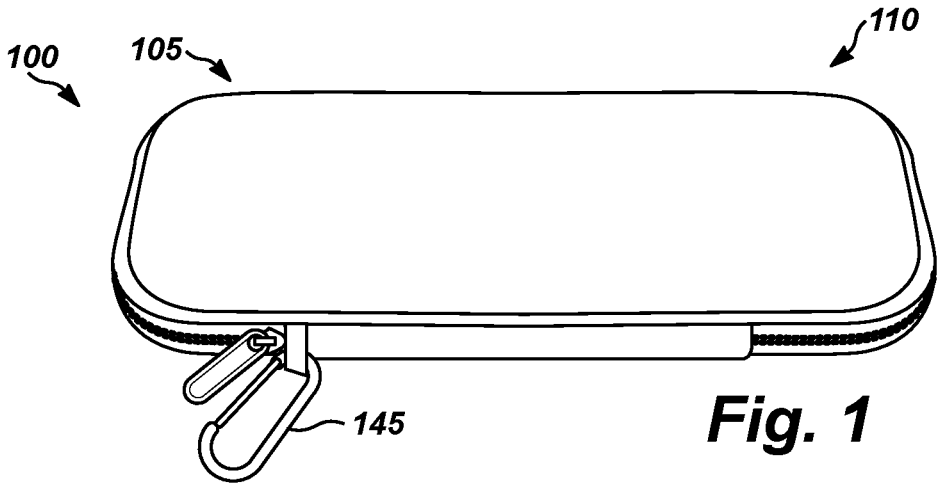
FIG. 1 is a top view of an exemplary embodiment of the present invention.

FIGS. 1-5 illustrate an exemplary embodiment of the exemplary disclosed system, apparatus, and method. System 100 may include an apparatus 105. Apparatus 105 may be an assembly for maintaining, storing, and/or organizing equipment for any suitable activity. For example, apparatus 105 may be used for maintaining, storing, and organizing equipment for a recreational activity (e.g., golf, baseball, football, lacrosse, bowling, cycling and motorcycling, weightlifting, hunting, skiing, fishing, watersports, and/or any other suitable recreational activity), work or professional activity (e.g., electrical or mechanical work, construction work, medical care, law enforcement or military applications, and/or any other suitable work or professional activity), or any other suitable activity.

Apparatus 105 may include a housing 110, an organizational assembly 115, and a shaping assembly 120. Organizational assembly 115 and shaping assembly 120 may be movably supported by housing 110.

Housing 110 may be any suitable assembly for housing and supporting organizational assembly 115 and shaping assembly 120. Housing 110 may include a first member 125 and a second member 130. First member 125 and second member 130 may be integrally formed together or attached together via any suitable technique. For example, first member 125 and second member 130 may be attached via an attachment portion 135 that may be a direct attachment between first member 125 and second member 130 or an attachment portion attached between first member 125 and second member 130. Attachment portion 135 between first member 125 and second member 130 may be made by via stitching, adhesives, mechanical fasteners, and/or any other suitable attachment technique.

Figure 2:
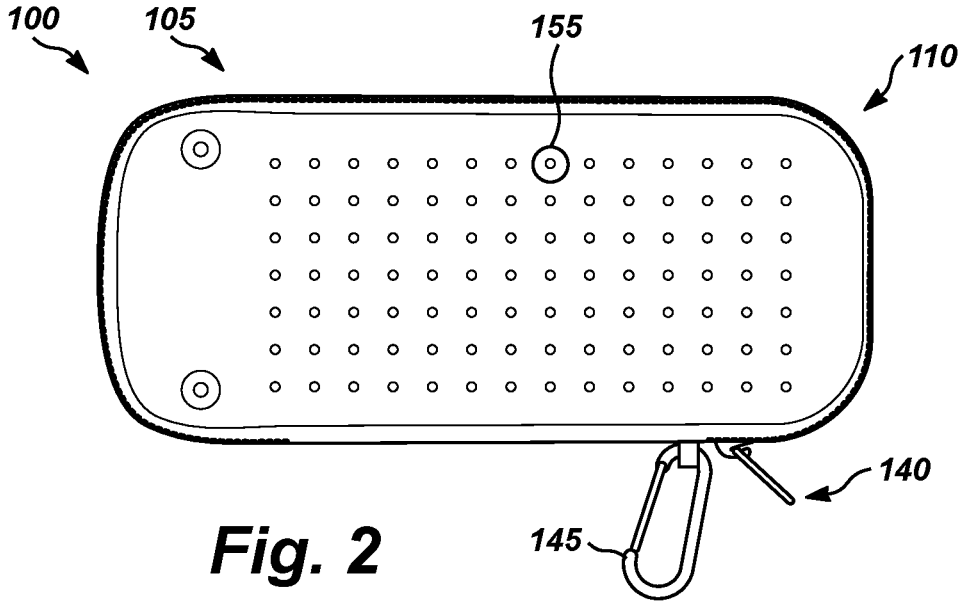
FIG. 2 is a bottom view of an exemplary embodiment of the present invention.
Figure 5:
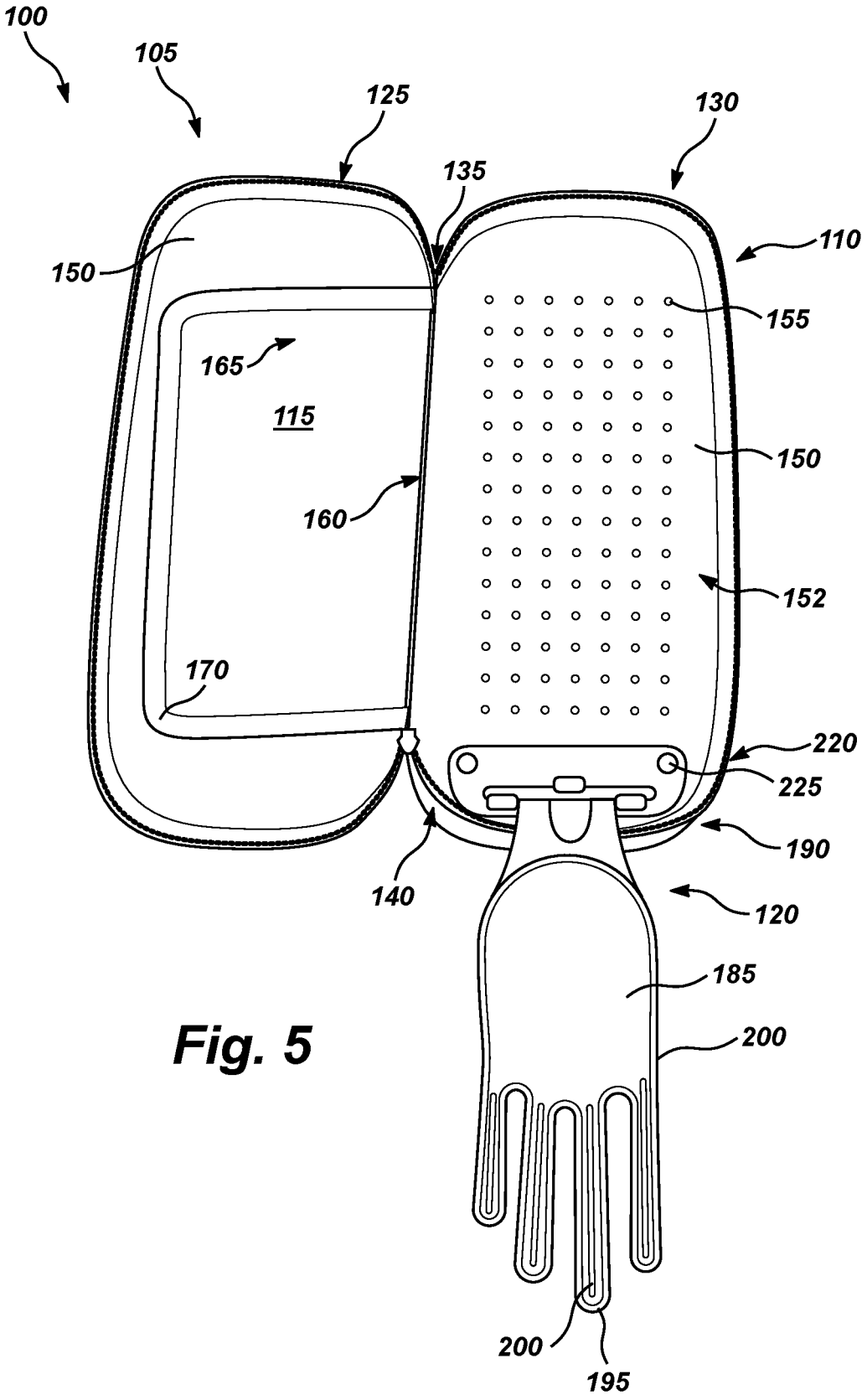
FIG. 5 is a top view of an exemplary embodiment of the present invention.

First member 125 and second member 130 may be moved relative to each other while attached for example between the relative position illustrated in FIGS. 1 and 2 (e.g., housing 110 in a closed position) and the relative position illustrated in FIG. 5 (e.g., housing 110 in a partially open or substantially fully open position). Housing 110 may include a fastener assembly 140 that may selectively fasten housing 110 in the closed position. Fastener assembly 140 may include any suitable fasteners such as, for example, zippers, magnets, buttons, mechanical fasteners, and/or any other suitable fastener. For example, fastener assembly 140 may be a zipper assembly disposed along corresponding perimeters or peripheries of first member 125 and second member 130. Fastener assembly 140 may serve to fasten first member 125 and second member 130 together in a closed position (e.g., as illustrated in FIGS. 1 and 2) to secure items such as the exemplary disclosed equipment in housing 110 described herein.

Housing 110 may also include an external fastener 145 for example as illustrated in FIGS. 1 and 2 that may be attached to first member 125 and/or second member 130. External fastener 145 may be any suitable fastener for securing apparatus 105 to an object such as a bag, a structure, clothing, or any other desired object. Fastener 145 may include a mechanical fastener, a clip, a carabiner, a magnet, an adhesive strip, a hook and loop fastener, a retractable locking device, a friction-fit locking device, a compressible locking device, and/or any other suitable attachment devices.

Housing 110 may be formed from any suitable material for supporting organizational assembly 115 and shaping assembly 120 and storing equipment such as for example the exemplary disclosed equipment described herein. Housing 110 may include any suitable structural material such as, for example, plastic, polymer, textiles, fabric, composite material, leather, wood, metal, and/or any other suitable structural material. For example, housing 110 may be formed from nylon fabric material. Housing 110 may be formed from vinyl, foam, or acetate material. Housing 110 may be formed from ethylene-vinyl acetate (EVA) material. Housing 110 may be thermoformed. Housing 110 may include ballistic nylon. Housing 110 may be formed from foam thermoformed with nylon. Housing 110 may be formed from "full grain leather" and/or synthetic "genuine leather." Housing 110 may be formed from nylon, leather, and/or polyurethane. In at least some exemplary embodiments, housing 110 may be formed from EVA foam thermoformed with 600D-900D ballistic nylon.

Housing 110 may include an elastic or flexible material disposed on an interior side of first member 125 and second member 130 (e.g., forming and/or facing an interior cavity 152 within housing 110 when housing 110 is in the closed position for example as illustrated in FIGS. 1 and 2). For example, an interior layer 150 disposed at the interior side of first member 125 and second member 130 may be formed from any suitable elastic or flexible material such as textiles, felt, foam, natural fiber material, synthetic fiber material, cotton, elastomeric material, rubber, polyester, open cell foam sheet material, and/or any other suitable material that may provide a soft, flexible, and/or elastic layer to interior surfaces of housing 110.

Figure 11:
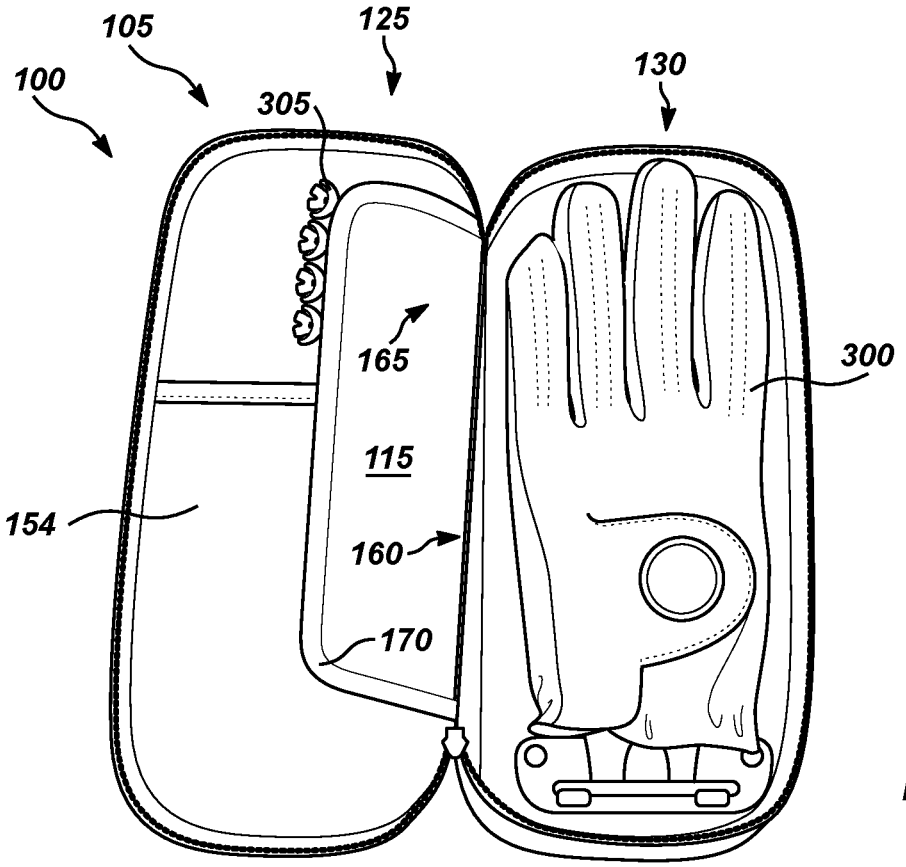
FIG. 11 is a top view of an exemplary embodiment of the present invention.
Figure 12:
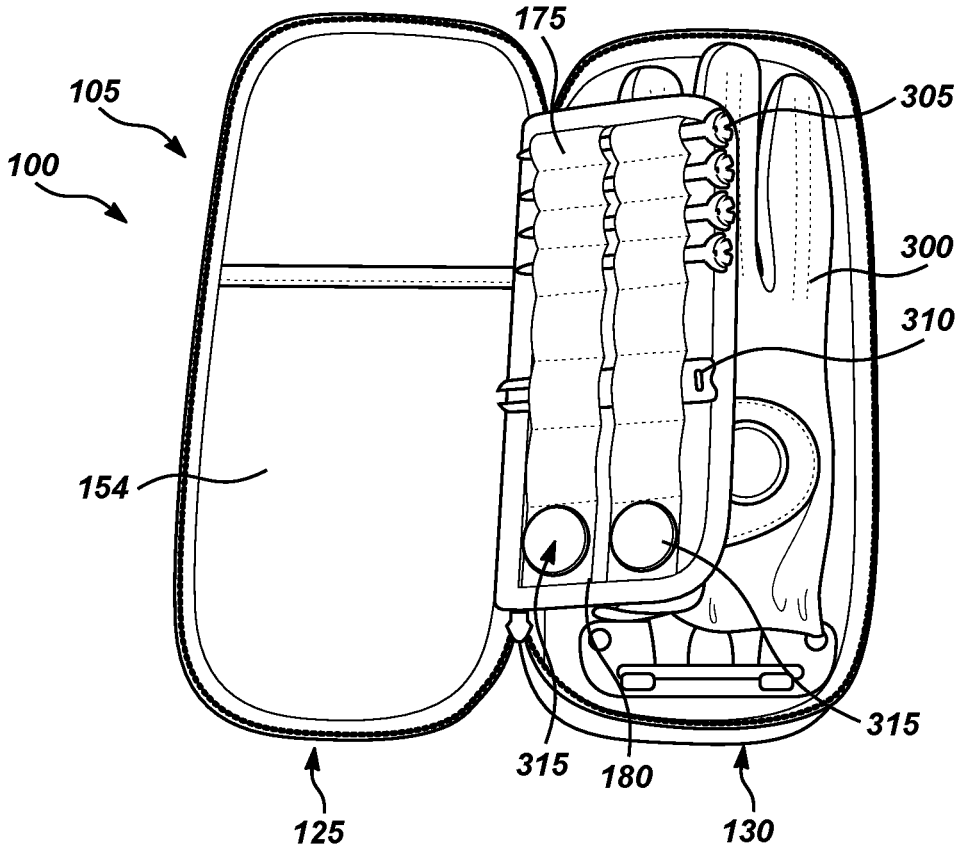
FIG. 12 is a top view of an exemplary embodiment of the present invention.

In at least some exemplary embodiments and as illustrated in FIGS. 11 and 12, a member 154 may be attached to first member 125, second member 130, and/or interior layer 150. Member 154 may be formed from material similar to interior layer 150 (e.g., and/or first member 125 and second member 130). Member 154 may be a sheet member. Member 154 may be a flexible or elastic member. In at least some exemplary embodiments, member 154 may be netting (e.g., fabric netting). Member 154 and a portion of interior layer 150 may together form a pocket for storing items (e.g., the exemplary disclosed equipment for example described herein). In at least some exemplary embodiments, member 154 may be a member for housing (e.g., holding) cigars or other tobacco products. For example, member 154 may be an insert that may be selectively opened and closed to receive cigars. In at least some exemplary embodiments, member 154 may be a foam insert.

Returning to FIGS. 1-5, first member 125 and/or second member 130 may include one or more (e.g., a plurality of) apertures 155. In at least some exemplary embodiments, second member 130 may include apertures 155 and first member 125 may not include apertures 155 (e.g., or both first member 125 and second member 130 may include apertures 155). Apertures 155 may extend through a thickness (e.g., an entire thickness) of first member 125 and/or second member 130. Apertures 155 may allow air and moisture to pass (e.g., may allow airflow) between interior cavity 152 of housing 110 (e.g., when housing 110 is in the closed position illustrated in FIG. 2) and the outside of housing 110 (e.g., air or atmosphere surrounding housing 110). Apertures 155 may be holes created (e.g., formed) via laser cutting. Apertures 155 may be laser-cut holes. For example, apertures 155 may be laser holes (e.g., manufactured laser holes). Apertures 155 may allow for drying of equipment stored in interior cavity 152 of housing 110 (e.g., when housing 110 is in the closed position illustrated in FIG. 2).

Figure 3:
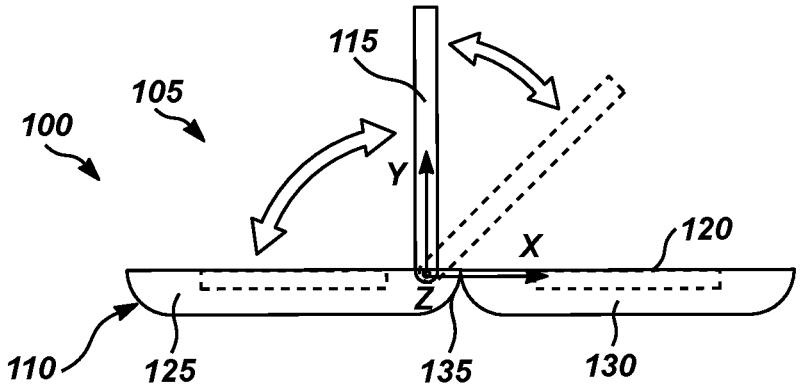
FIG. 3 is a side view of an exemplary embodiment of the present invention.

Organizational assembly 115 may be any suitable assembly for being movably attached to housing 110. Organizational assembly 115 may be attached to first member 125, second member 130, and/or attachment portion 135 via any suitable attachment technique or may be integrally formed with first member 125, second member 130, and/or attachment portion 135. For example, organizational assembly 115 may be attached to first member 125, second member 130, and/or attachment portion 135 via stitching, adhesives, mechanical fasteners, and/or any other suitable attachment technique. A side portion 160 (e.g., a partial or substantially entire length) of organizational assembly 115 may be attached to first member 125, second member 130, and/or attachment portion 135. Organizational assembly 115 may be moved relative to housing 110 for example as illustrated in FIG. 3. For example, organizational assembly 115 may be rotatably moved relative to housing 110 about the attachment of side portion 160 to first member 125, second member 130, and/or attachment portion 135. For example, organizational assembly 115 may be rotated relative to housing 110 to any desired position between the exemplary positions illustrated in FIGS. 11 and 12. Organizational assembly 115 may be a sewn-in flap of housing 110.

Returning to FIGS. 1-5, organizational assembly 115 may be a substantially flat member. Organizational assembly 115 may be a sheet member. Organizational assembly 115 may be a substantially flat, flexible member. Organizational assembly 115 may be formed from any suitable material such as material similar to housing 110. In at least some exemplary embodiments, organizational assembly 115 may be a flat member formed from plastic, polymer, textiles, fabric, composite material, leather, wood, metal, and/or any other suitable structural material. Organizational assembly 115 may include a layer 165 covering some or all of one or both sides of organizational assembly 115 that may be formed from similar material as interior layer 150. Organizational assembly 115 may include an end portion 170 that may be a seam and/or include additional material (e.g., padding) formed from material similar to interior layer 150. For example, end portion 170 may provide a padded area that may be comfortable for being touched or moved by a user.

Organizational assembly 115 may include one or more elastic fasteners 175 for example as illustrated in FIG. 12. Elastic fasteners 175 may be attached to one or both sides of organizational assembly 115 (e.g., to layer 165) via any suitable technique such as via stitching, adhesives, mechanical fasteners, and/or any other suitable attachment technique. Elastic fasteners 175 may be formed from any suitable flexible or elastic material such as nylon, spandex, polyester, elastomeric material, rubber, and/or any other suitable elastic material for retaining any suitable items such as the exemplary disclosed equipment for example as described. Portions of elastic fasteners 175 (e.g., a strip fastener) may be attached to organizational assembly 115 at any desired interval so as to form a plurality of pockets or sections for retaining items. A magnet 180 may be attached to or retained (e.g., via stitching, adhesives, clips, or any other suitable fasteners) by elastic fastener 175. Magnet 180 may be sewn-in to elastic fastener 175.

Returning to FIGS. 1-5, shaping assembly 120 may include a shaping member 185 and a support assembly 190. Shaping member 185 may be movably (e.g., rotatably) supported via support assembly 190.

Shaping member 185 may be formed from any suitable structural material such as, for example, material similar to housing 110 and/or organizational assembly 115. Shaping member 185 may be formed from any suitable rigid or inflexible material (e.g., or a flexible material). Shaping member 185 may be formed from plastic (e.g., hard plastic), metal, wood, composite material, and/or any other suitable material. In at least some exemplary embodiments, shaping member 185 may be formed from EVA material for example similar to as described above regarding housing 110. Shaping member 185 may also be formed from any suitable moisture-absorbing material.

Figure 8:
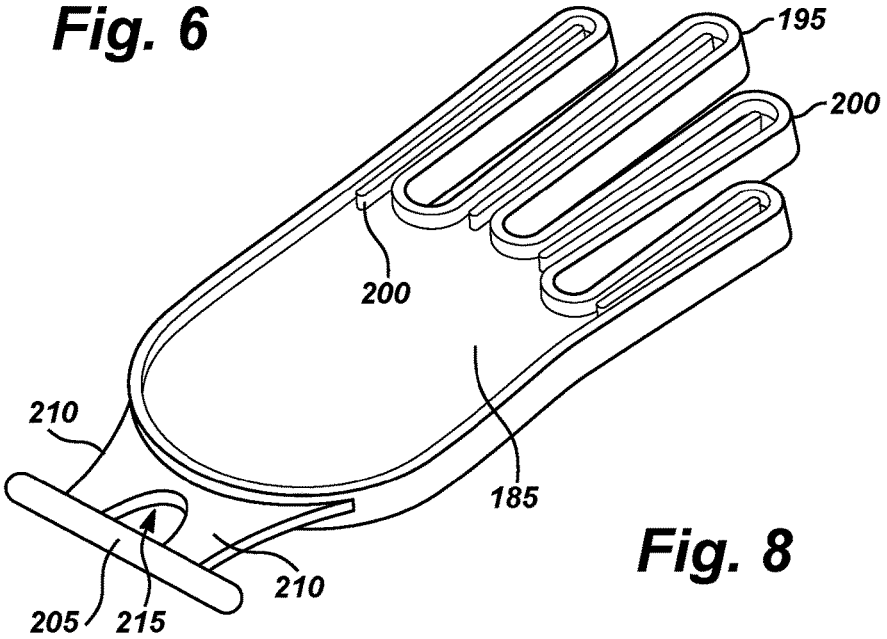
FIG. 8 is a perspective view of an exemplary embodiment of the present invention.
Figure 9:
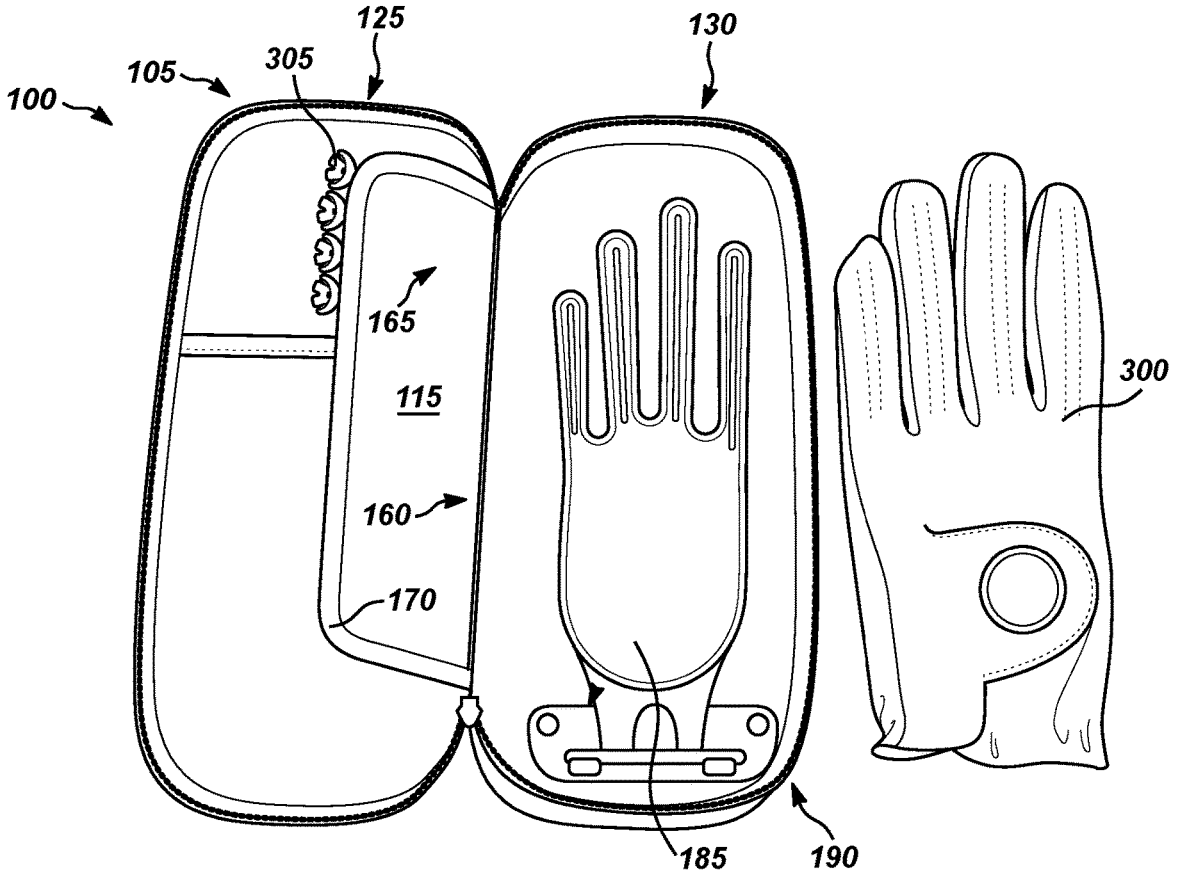
FIG. 9 is a top view of an exemplary embodiment of the present invention.

As illustrated in FIGS. 5 and 8, shaping member 185 may be configured or shaped in any desired form. For example, shaping member 185 may include a plurality of tines 195. Portions of shaping member 185 may include stiffeners 200 (e.g., ribs) that may stiffen portions of shaping member 185. Stiffeners 200 may be formed from similar material as shaping member 185 and may be integrally formed with or attached by any suitable technique to shaping member 185. For example, stiffeners 185 may be disposed at tines 195 to stiffen tines 195 and/or may be disposed along a perimeter of shaping member 185. In at least some exemplary embodiments, shaping member 185 may be configured to receive a glove with tines 195 configured to receive digit (e.g., finger and/or thumb) portions of the glove. For example, shaping member 185 may be hand-shaped with four or five tines 195 (e.g., finger-shaped or digit-shaped tines) to receive digit portions of a glove.

For example as illustrated in FIG. 8, shaping member 185 may include an elongated member 205 that may be integrally formed with (e.g., an integral portion of) or attached to shaping member 185. Elongated member 205 may be configured to be received in a portion of support assembly 190 for example as described below. Elongated member 205 may be integrally formed with or attached to shaping member 185 via portions 210. An aperture 215 may be formed by elongated member 205 and portions 210, which may receive a portion of support assembly 190. Elongated member 205 and portions 210 may be formed from material similar to shaping member 185.

Figure 6:
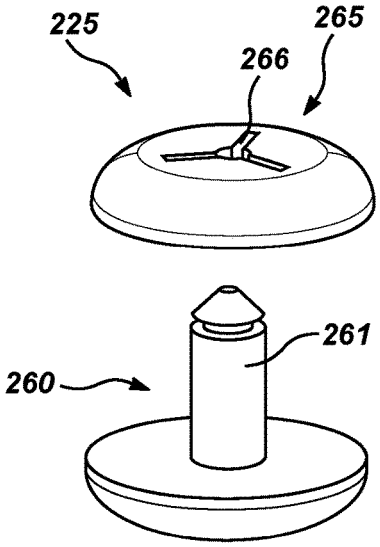
FIG. 6 is an perspective view of an exemplary embodiment of the present invention.
Figure 7:
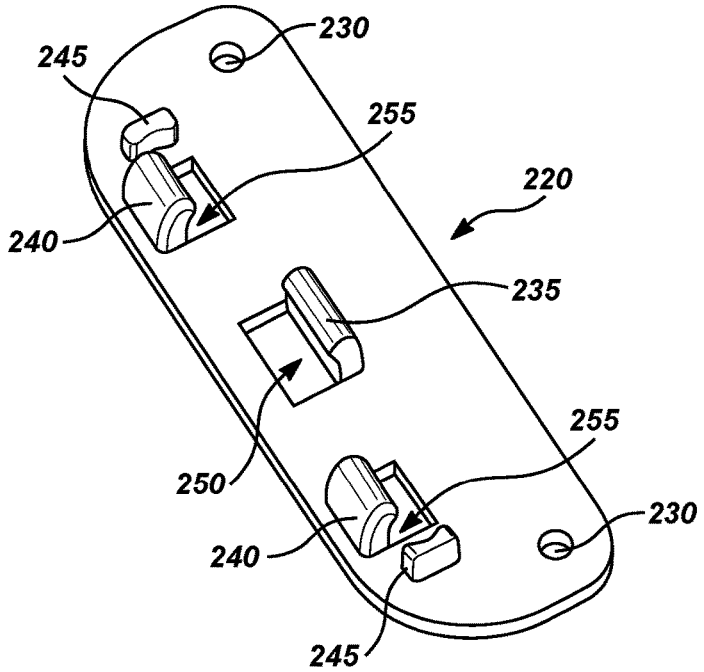
FIG. 7 is a perspective view of an exemplary embodiment of the present invention.

As illustrated in FIGS. 5-7, support assembly 190 may include a base member 220 and one or more (e.g., a plurality of) fastener assemblies 225. Fastener assembly 225 may attach base member 220 to first member 125 (e.g., or second member 130).

Base member 220 may be formed from material similar to shaping member 185. Base member 220 may include one or more apertures 230 for receiving a portion of fastener assembly 225. Base member 220 may also include a plurality of protrusions 235, 240, and 245 configured to receive elongated member 205. For example, protrusions 235, 240, and 245 may be disposed on each side and end portions of elongated member 205. Protrusions 235, 240, and 245 may be flexible so that elongated member 205 may be removably attached between protrusions 235, 240, and 245 to base member 220. For example, elongated member 205 of shaping member 185 may be snappably received (e.g., snapped into and snapped out of) protrusions 235, 240, and 245. Apertures 250 and 255 may be disposed adjacent to protrusions 235 and 240 for example as illustrated in FIG. 7.

Figure 4:
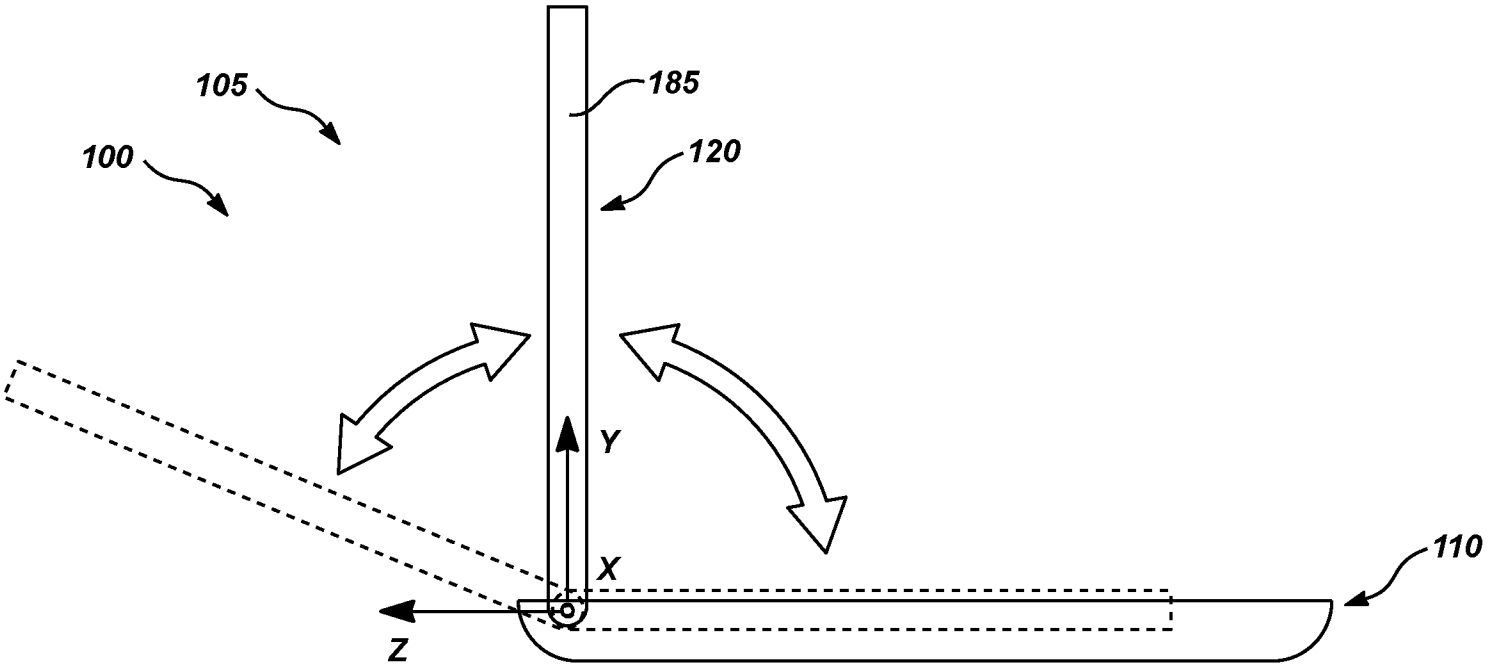
FIG. 4 is a side view of an exemplary embodiment of the present invention.

Apertures 250 and 255 may provide cutouts of material that may allow protrusions 235 and 240 relatively more flexibility for facilitating snap-in and snap-out of elongated member 205. When elongated member 205 is received between protrusions 235, 240, and 245, elongated member 205 may be rotatable. For example, elongated member 205 may be removably, rotatably (e.g., and snappably) received between protrusions 235, 240, and 245 so that shaping member 185 may be rotated to any desired position for example as illustrated in FIG. 4. In at least some exemplary embodiments, protrusions 245 may be side rails or bumpers that maintain elongated member 205 in place during rotation (e.g., pivoting).

Fastening assembly 225 may include a base fastener 260 and a fastener 265. Fastener 265 may include an aperture 266 for receiving (e.g., snappably and/or fixedly receiving) a protrusion 261 of base member 260. Fastener assembly 225 may be formed from any suitable material such as, for example, material similar to shaping member 185. In at least some exemplary embodiments, fastener assembly 225 may be formed from plastic, metal, or any other suitable structural material. Fastener assembly 225 may be a threaded bolt, a rivet assembly, or any other suitable fastener assembly. In at least some exemplary embodiments, fastener assembly 225 may be a plastic snap rivet assembly. One or more fastener assemblies 225 may permanently or fixedly attach base member 220 to first member 125 (e.g., or second member 130) based on protrusion 261 being received through aperture 230 of base member 220 and a corresponding (e.g., aligned) aperture of first member 125 (e.g., or second member 130). One or more fastener assemblies 225 may thereby fixedly attach base member 220 to an interior side of first member 125 (e.g., or second member 130). Base member 220 may thereby be fastened in interior cavity 152 of housing 110.

As illustrated in FIGS. 9-12, system 100 may be used for maintaining, storing, and/or organizing any suitable equipment such as, for example, a glove 300, a golf tee 305, a divot tool 310, a ball marker 315, and/or any other desired equipment. The exemplary disclosed equipment may be maintained, stored, and/or organized using apparatus 105.

Figure 10:
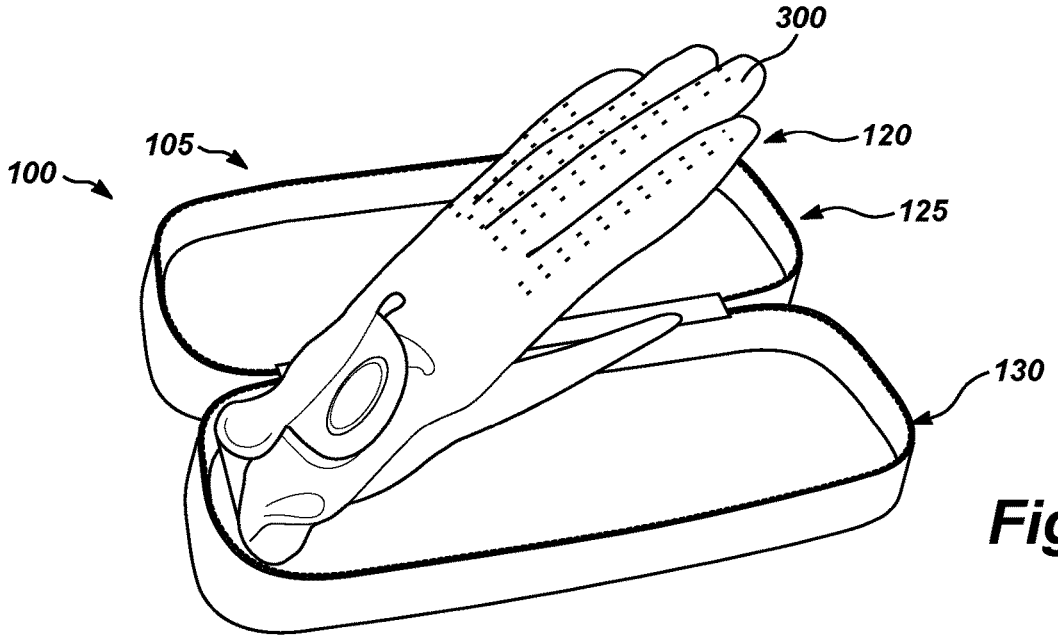
FIG. 10 is a perspective view of an exemplary embodiment of the present invention.

Glove 300 may be received by shaping member 185. For example, digit or finger portions of glove 300 may be received by respective tines 195 so that a suitable shape of glove 300 is maintained (e.g., so that glove 300 does not become balled up or finger portions and other portions of glove 300 become stuck together and difficult for a user to don following storage). Shaping member 185 may thereby shape glove 300 while it is stored in housing 110. For example, a user may open (e.g., unfasten or unzip) apparatus 105 and open apparatus 105 from the closed position shown in FIGS. 1 and 2 to the open position shown in FIG. 9. The user may then move (e.g., rotate) shaping member 185 to any desired position such as illustrated in FIGS. 4 and 5 that may facilitate placing glove 300 onto shaping member 185 (e.g., as illustrated in FIG. 10). Shaping member 185 holding glove 300 may then be moved (e.g., rotated) into interior cavity 152 for example as illustrated in FIG. 11. The user may then close and fasten (e.g., zip) first member 125 and second member 130 together with shaping member 185 holding glove 300 in interior cavity 152 so that apparatus 105 is in the closed and fastened position illustrated in FIGS. 1 and 2. While glove 300 is stored in apparatus 105, apertures 155 may allow air and moisture (e.g., of glove 300 may that be wet) to pass between interior cavity 152 of housing 110 and the outside of housing 110. Such airflow through apertures 155 may allow for glove 300 to dry while stored in apparatus 105.

Any desired items may be stored using member 154 (e.g., in between member 154 and interior layer 150 of first member 125 or of second member 130). For example, paper, a scorecard, a yardage book, pencils or pens, balls (e.g., golf ball), and/or any other suitable equipment for any of the exemplary disclosed activities for use with apparatus 105 may be stored in between member 154 and interior layer 150.

Any desired items may be stored using organizational assembly 115. For example, one or more golf tees 305, one or more divot tools 310, one or more ball markers 315, and/or any other desired items may be stored in the exemplary disclosed pockets or sections formed by elastic fasteners 175. Metal items such as ball markers 315 may be magnetically attached to magnet 180 for storage. Organizational assembly 115 may be moved (e.g., rotated) between any desired location between the positions illustrated in FIGS. 11 and 12.

Organizational assembly 115 may serve as a separator between glove 300 received on shaping assembly 185 and items stored on organizational assembly 115 and by member 154. For example as illustrated in FIG. 11, items may be stored on a side or face of organizational assembly 115 facing member 154, while a reverse side or face of organizational assembly 115 may not store items and may face glove 300 when apparatus 105 is closed and fastened. Accordingly, organizational assembly 115 may serve to separate or block moisture of glove 300 received by shaping member 185 from dampening items stored on the reverse side of organizational assembly 115 and by member 154 when apparatus 105 is in the closed and fastened position illustrated in FIGS. 1 and 2 (e.g., as glove 300 is drying based on airflow carrying moisture from glove 300 out of interior cavity 152 via apertures 155).

Organizational assembly 115 and shaping member 185 may move or rotate (e.g., pivot) about different axes to facilitate effective and compact organization and storage of the exemplary disclosed items in apparatus 105. For example as illustrated in FIG. 3, organizational assembly 115 may pivot or rotate about an axis z (e.g., where axis z may be in a length direction of apparatus 105, an axis x that may be in a width direction of apparatus 105, and an axis y that may be in a height direction of apparatus 105). For example as illustrated in FIG. 4, shaping member 185 may pivot or rotate about axis x (e.g., or an axis parallel to axis x). In at least some exemplary embodiments, shaping member 185 may rotate or pivot perpendicularly relative to a rotation or pivoting of organizational assembly 115. This exemplary disclosed relative rotation or pivoting may allow organizational assembly 115 to be folded over shaping member 185 to provide compact and effective storage and drying of the exemplary disclosed items.

Figure 13:
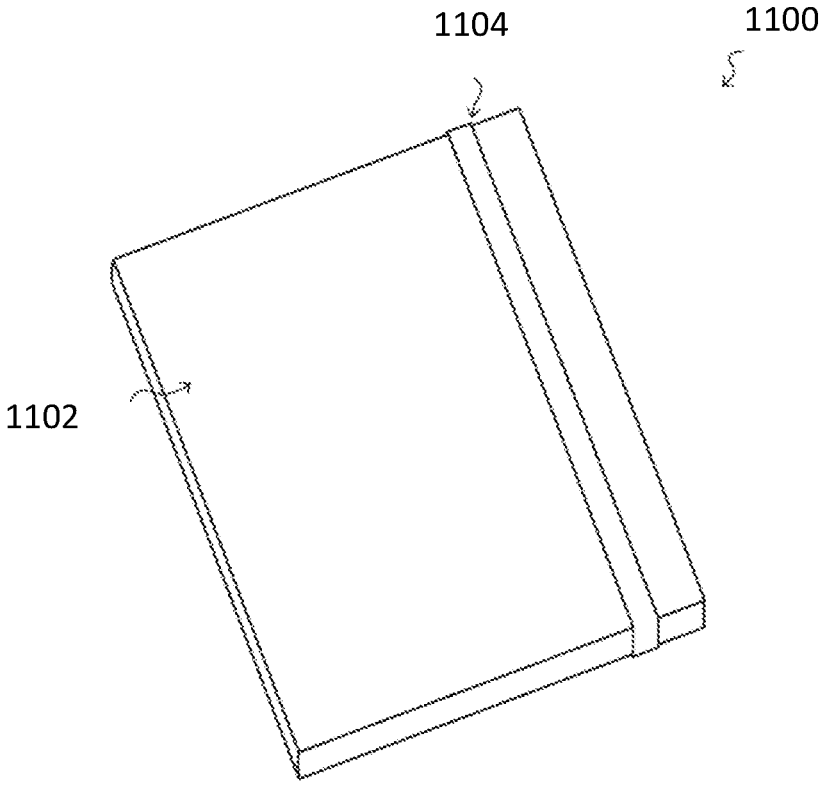
FIG. 13 is a perspective view of an exemplary embodiment of the present invention.

FIGS. 13-17 illustrate another exemplary embodiment of the exemplary disclosed system, apparatus, and system, system 1100. FIG. 13 illustrates a front exterior portion of a hinging glove shaper and organizer that may be configured to store and organize golf items or any other suitable items for example as described herein. The hinging glove shaper and organizer may include a leather exterior and interior 1102, 1116, 1118, and 1126, an elastic fastener 1104, an elastic fastener with mesh pocket 1112 to house a divot tool, one or more elastic golf tee fasteners 1110, magnetic circle 1108 to fasten a ball marker or similar sized item, a sewn-in pocket to fasten a yardage book 1106, a hinging mechanism

1120, a glove shaper 1114, and a golf ball fastener 1122. The exterior and interior may be formed from any suitable material such as leather, plastic, wood, metal, or a combination thereof. Elastic fastener 1104 may be formed from any suitable material such as nylon, spandex, polyester, or a combination thereof. Elastic fastener 1104 may include any suitable devices such as zippers, magnets, buttons or a combination thereof.

Figure 14:
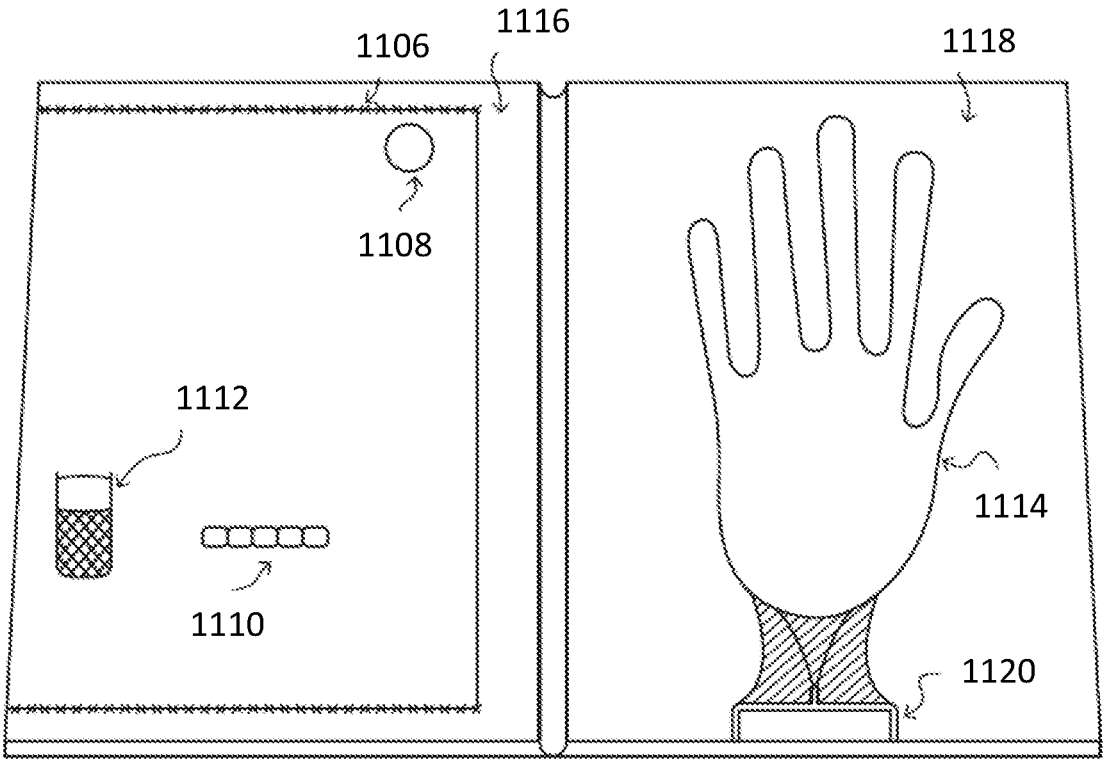
FIG. 14 is a top view of an exemplary embodiment of the present invention.

FIG. 14 illustrates left inner surface 1116 having sewn-in pocket 1106 on a top and bottom with an opening facing a medial aspect of the device. Sewn-in pocket 1106 may be formed from any suitable material such as leather, mesh, cloth or a combination thereof. Sewn into sewn-in pocket 1106 may be an elastic fastener with mesh pocket 1112 that may house a divot tool or similarly sized object. Additionally for example, sewn into sewn-in pocket 1106 may be golf tee fasteners that may house golf tees or a similarly sized item. Fastened in a top-right corner of sewn-in pocket 1106 may be a magnetic circle 1108 secured by any suitable material such as adhesive (e.g., glue), stitching, magnets, or a combination thereof to house a ball marker or similar item.

Figure 16:
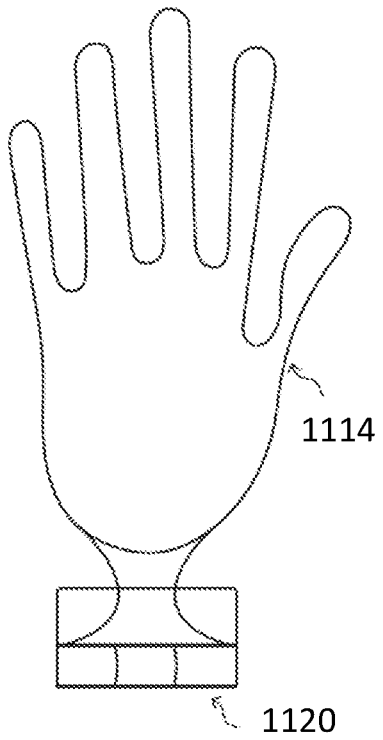
FIG. 16 is a top view of an exemplary embodiment of the present invention.
Figure 17:
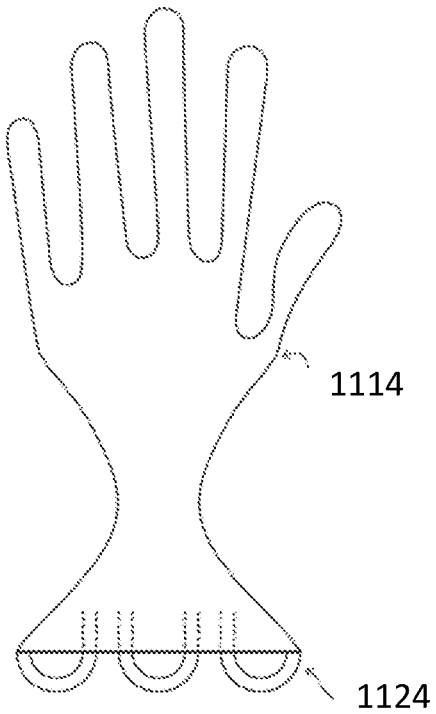
FIG. 17 is a top view of an exemplary embodiment of the present invention.

FIG. 14 also illustrates right inner surface 1118. Hinging mechanism 1120 may be secured into a bottom portion formed from any suitable material such as metal, plastic, wood, or combination thereof. A base of hinging glove shaper 1124 illustrated in FIG. 17 may be configured in a way that interlocks the substantially entire hinging glove shaper 1114 with hinging mechanism 1120 fastened to the bottom of right inner surface 1118. Hinging mechanism 1120 may interlock and attach to hinging glove shaper 1114 securely via a locking pin formed from any suitable material such as metal, plastic, wood, or combination thereof for example as illustrated in FIG. 16. This interlocking relationship between hinging mechanism 1120 and hinging glove shaper 1114 may allow hinging glove shaper 1114 to freely move (e.g., rotate) in a longitudinal (e.g., sagittal) plane of motion, lifting off of right inner surface 1118. This movement established by the interlocking relationship between hinging mechanism 1120 and hinging glove shaper 1114 may allow the user to easily don and doff a glove onto hinging glove shaper 1114.

Figure 15:
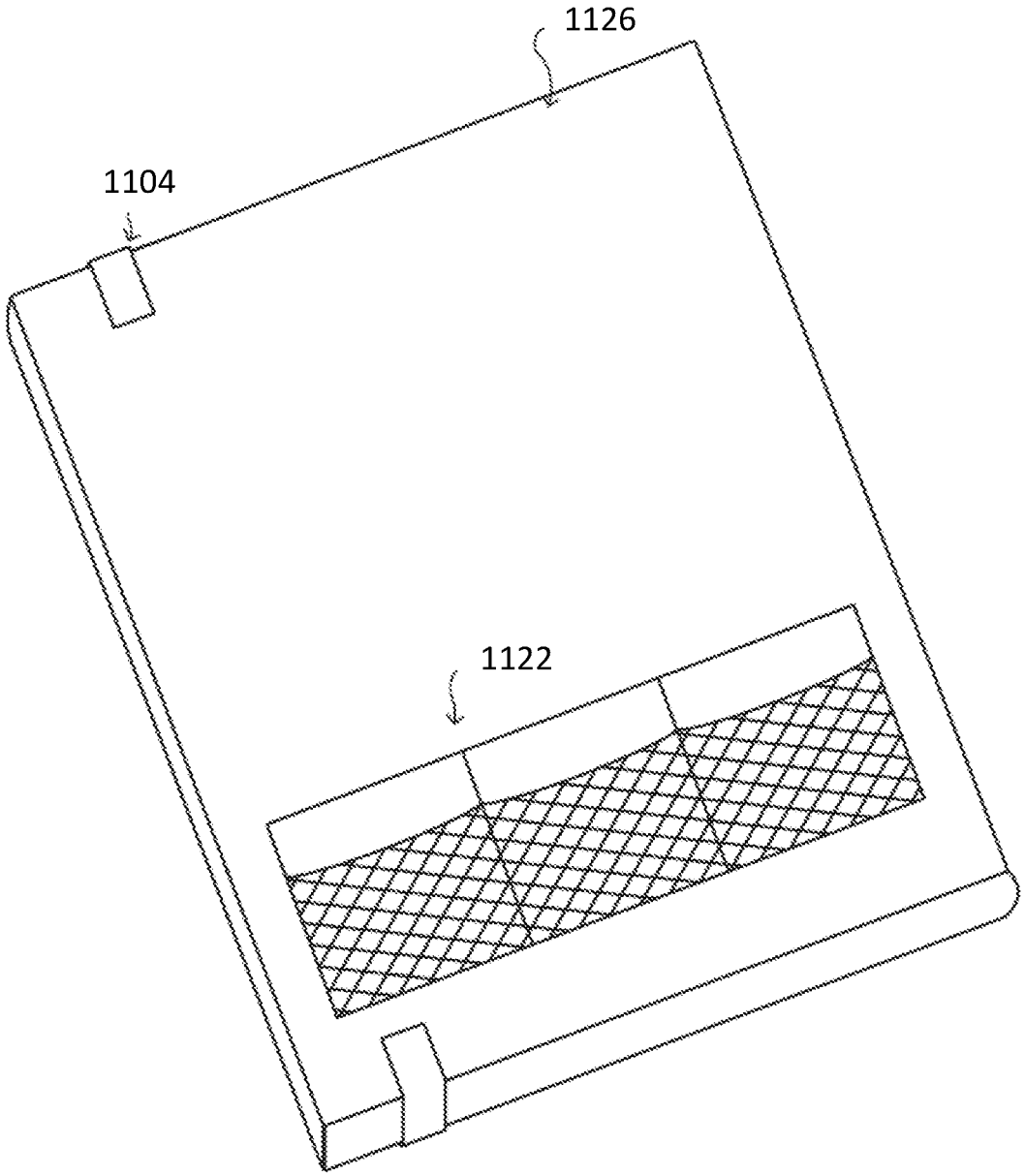
FIG. 15 is a perspective view of an exemplary embodiment of the present invention.

FIG. 15 illustrates the back exterior portion of hinging glove shaper and organizer 1126. Elastic fastener 1104 may be secured into the top and bottom portions of the back exterior portion of hinging glove shaper and organizer 1126. Elastic fastener 1104 may be formed from any suitable material such as nylon, spandex, polyester, or a combination thereof. Elastic fastener 1104 may include any suitable devices such as zippers, magnets, buttons, or a combination thereof. Elastic fastener 1104 may be secured via any method such as stitching, adhesive (e.g., glue), staples, or combination of thereof. On the bottom portion of the back exterior portion of hinging glove shaper and organizer 1126 may be one or more elastic fasteners with one or more mesh pockets 1122 to store one or more golf balls or similarly sized items.

In at least some exemplary embodiments, the exemplary disclosed system, apparatus, and method may be a hinging glove shaper and organizer that securely houses a wide spectrum of items ranging in a variety of sizes. The hinging glove shaper and organizer may include a hinging glove shaper that moves freely inside the device to allow ease of use for the user when donning and doffing a glove.

In at least some exemplary embodiments, the exemplary disclosed system, apparatus, and method may include a glove shaper device that provides a hinging motion that allows the user to lift the device off of a surface and don and/or doff a glove. This hinging glove shaper may allow users to place a glove onto the device to effectively store and dry the glove. Airflow and ventilation may be allowed into the case for effective drying of the glove after use. Inside of the case may be a sewn-in flap with elastic loops that may house golf items such as tees, divot tools (e.g., and may have sewn-in magnets for housing of ball markers). The anterior inner side of the case may include a mesh pocket for storage of other items such as a mobile device (e.g., cellphone), wallet, keys, and other similar sized items.

In at least some exemplary embodiments, the exemplary disclosed system, apparatus, and method may include a "hinge" device of a shaping member that may allow the device to be assembled into an EVA case and may allow the device to be used by being lifted and placed back into the case. The base of the hinge may be attached to the EVA case via two individual plastic snap rivets and the "hand shaper" component may then be snapped into the "hinging" component of the base. There may be two side rails/bumpers on the base of the hinge to prevent lateral shifts of the hand shaper that may impair the "hinging" motion. An inner "flap" may allow organized storage of items and may include one or more (e.g., two) magnets sewn into place for the storage of magnetic ball markers. The back of the EVA case may include holes created via laser cutting that allow airflow and effective drying of the glove on the shaper.

In at least some exemplary embodiments, the exemplary disclosed system, apparatus, and method may allow a glove to retain a suitable (e.g., proper) shape while being securely housed inside of a closed environment to reduce exposure to outside elements as well preventing the glove from falling off or out of the device and being lost. The airholes may allow natural drying of the glove without exposing a majority of the glove to external factors. A thumb portion of the hand shaper may be removed to allow relatively easier donning and/or doffing of the glove.

In at least some exemplary embodiments, the exemplary disclosed system, apparatus, and method may include an anterior inner component fitted with a cigar case that may house a plurality (e.g., four cigars) individually, including a cover to protect the cigars from interacting with other items inside of the case. Also, a magnet may be installed on a posterior component of the case to allow attachment (e.g., fixation) to a golf cart for easier access to the device during play. Alternative fastening techniques may also include a button, an elastic strap, materials disposed on or at an outside surface including leather and/or nylon. The case may also include dual hand shapers (e.g., one on the anterior and one on the posterior) to store more than one glove for dual glove sports or activities.

In at least some exemplary embodiments, the exemplary disclosed system, apparatus, and method may be related generally to golf accessories, and may be a hinging glover shaper and organizer. The exemplary disclosed system, apparatus, and method may include a hinging glover shaper and organizer including a leatherbound booklet that opens to reveal organizational components of the device. The top and bottom portion of the leatherbound booklet may have a fastening component. A left inner surface may be configured to store a predetermined amount of golf tees securely. The left inner surface may be configured to store a divot tool securely. The left inner surface may include a magnetic device fastened securely, with opposite polarity in order to attract and safely secure a ball marker. The left inner surface may include liftable pocket to securely hold a yardage book. The right inner surface may include a hinging glover shaper to securely hold and shape a golf glove. The right inner surface may have a hinge secured to the bottom portion. A hinge located on the right inner surface may connect to the glover shaper, allowing it to lift off of the right inner surface. The back portion of the device may have mesh pockets secured into the leather booklet to hold a predetermined amount of golf balls.

In at least some exemplary embodiments, the exemplary disclosed system, apparatus, and method may be a hinging glove shaper, including a body and a base, the base having an interlocking component to connect to a hinging component and secured via a locking pin allowing a relatively large degree of motion in a longitudinal (e.g., sagittal) plane. In at least some exemplary embodiments, the exemplary disclosed system, apparatus, and method may be a hinging glove shaper and organizer, including a leather casing including an exterior and interior that is secured via an elastic fastener, and a hinging glove shaper fastened in the interior aspect allowing a relatively large arc of motion away from the interior surface, and an interior portion consisting of multiple fasteners to store a large range of items varying in size.

The exemplary disclosed system, apparatus, and method may be used in any suitable application for maintaining, storing, and organizing equipment for any suitable activity. For example, the exemplary disclosed system, apparatus, and method may be used for maintaining, storing, and organizing equipment for a recreational activity such as golf, baseball, football, lacrosse, bowling, cycling and motorcycling, weightlifting, hunting, skiing, fishing, watersports, and/or any other suitable recreational activity. The exemplary disclosed system, apparatus, and method may also be used in any suitable work or professional activity such as electrical or mechanical work, construction work, medical care, law enforcement or military applications, or any other suitable work or professional activity.

In at least some exemplary embodiments, the exemplary disclosed apparatus may be an apparatus for storing equipment that may include a housing including a plurality of members configured to rotate relative to each other, about an attachment portion of the plurality of members, between a closed position forming an interior cavity and an open position, an assembly attached to the housing and configured to rotate relative to the housing, a shaping member attached to one of the plurality of members and configured to rotate relative to the one of the plurality of members, and at least one aperture extending through the one of the plurality of members. The shaping member may be configured to removably receive the equipment. The assembly may be configured to rotate about the attachment portion or about an axis parallel to the attachment portion. The equipment may include a glove and the shaping member includes a plurality of tines configured to receive digit portions of the glove. The exemplary disclosed apparatus may further include fabric netting attached to a second of the plurality of members, the assembly separating the fabric netting and the shaping member in the interior cavity when the plurality of members are in the closed position. The exemplary disclosed apparatus may further include at least one elastic fastener attached to a surface of the assembly that faces the fabric netting when the plurality of members are in the closed position. The shaping member may be attached to the one of the plurality of members via a hinge assembly that is attached to the one of the plurality of members via a snap rivet assembly. The at least one aperture may be a plurality of laser-cut holes. The plurality of members may be formed from at least one selected from the group of nylon, leather, polyurethane, and combinations thereof.

In at least some exemplary embodiments, the exemplary disclosed method may be a method for storing equipment, including providing a first member, providing a second member attached to the first member via an attachment portion, the second member including a plurality of apertures, rotating the first member and the second member relative to each other about the attachment portion between a closed position forming an interior cavity and an open position, providing an organizational assembly attached to the attachment portion or the first member, rotating the organizational assembly about the attachment portion or about a first axis parallel to the attachment portion, and providing a shaping member rotatably attached to the second member. The exemplary disclosed method may also include rotating the shaping member about a second axis that is substantially perpendicular to the attachment portion or the first axis, placing a piece of the equipment on the shaping member, and drying the piece of the equipment when it is placed on the shaping member in the interior cavity via the plurality of apertures when the first member and the second member are in the closed position. The exemplary disclosed method may also include disposing the organizational assembly between the first member including a storage pocket and the second member including the shaping member in the interior cavity when the first member and the second member are in the closed position. The organizational assembly may include a plurality of elastic fasteners disposed on a surface of the organizational assembly facing the storage pocket in the interior cavity when the first member and the second member are in the closed position. The exemplary disclosed method may further include storing additional pieces of equipment using the storage pocket and the plurality of elastic fasteners in the interior cavity when the first member and the second member are in the closed position, and separating the additional pieces of equipment from the piece of equipment that is drying in the interior cavity via the organizational assembly when the first member and the second member are in the closed position. Rotating the first member and the second member from the open position to the closed position forming the interior cavity may include rotating the shaping member including the piece of the equipment toward an interior surface of the second member, rotating the first member toward the second member so that the organizational assembly abuts against the shaping member including the piece of equipment in the interior cavity, and fastening a first perimeter of the first member to a second perimeter of the second member. Fastening the first perimeter of the first member to the second perimeter of the second member may include zipping the first perimeter of the first member to the second perimeter of the second member.

In at least some exemplary embodiments, the exemplary disclosed apparatus may be an apparatus for storing golf equipment including a golf glove, including a first member, a second member attached to the first member via an attachment portion, the first member and the second member configured to rotate relative to each other about the attachment portion between a closed position forming an interior cavity and an open position, an organizational assembly attached to the attachment portion or the first member, and configured to rotate about the attachment portion or about a first axis parallel to the attachment portion, a shaping member rotatably attached to the second member and configured to rotate about a second axis that is substantially perpendicular to the attachment portion or the first axis, and a plurality of apertures extending through the second member. The shaping member may be configured to removably receive the golf glove. The shaping member may be rotatably attached to the second member via a hinge assembly that is attached to the second member. The shaping member may include an elongated member. The hinge assembly may include a plurality of protrusions configured to removably, snappably, and rotatably receive the elongated member. The first member may include a storage pocket disposed in the interior cavity when the first member and the second member are in the closed position. The organizational assembly may include a plurality of elastic fasteners configured to receive a plurality of pieces of the golf equipment including a golf tee and a divot tool. The plurality of elastic fasteners may include a plurality of sewn-in magnets configured to receive the golf equipment including metal golf equipment. The shaping member may be a hand-shaped member including finger-shaped tines configured to receive finger portions of the golf glove.

In at least some exemplary embodiments, the exemplary disclosed system, apparatus, and method may provide an efficient and effective system for maintaining and organizing items for use in an activity such as golf. The exemplary disclosed system, apparatus, and method may also provide for proper maintenance and care of equipment such as a glove.

It will be apparent to those skilled in the art that various modifications and variations can be made to the exemplary disclosed apparatus, system, and method. Other embodiments will be apparent to those skilled in the art from consideration of the specification and practice of the exemplary disclosed apparatus, system, and method. It is intended that the specification and examples be considered as exemplary, with a true scope being indicated by the following claims.

What is claimed is:

1. An apparatus for storing equipment, comprising:

a housing including a plurality of members configured to rotate relative to each other, about an attachment portion of the plurality of members, between a closed position forming an interior cavity and an open position;

an assembly attached to the housing and configured to rotate relative to the housing;

a rigid shaping member attached to one of the plurality of members and configured to rotate relative to the one of the plurality of members; and at least one aperture extending through the one of the plurality of members;

wherein the rigid shaping member is configured to removably receive the equipment; and wherein the rigid shaping member includes a plurality of elongated portions configured to receive portions of the equipment, the plurality of elongated portions being rotatable relative to the one of the plurality of members based on the rigid shaping member being rotatably attached to the one of the plurality of members.

2. The apparatus of claim 1, wherein the assembly is configured to rotate about the attachment portion or about an axis parallel to the attachment portion.

3. The apparatus of claim 1, wherein the equipment includes a glove and the plurality of elongated portions of the rigid shaping member are a plurality of tines configured to receive digit portions of the glove.

4. The apparatus of claim 1, further comprising fabric netting attached to a second of the plurality of members, the assembly separating the fabric netting and the rigid shaping member in the interior cavity when the plurality of members are in the closed position.

5. The apparatus of claim 4, further comprising at least one elastic fastener attached to a surface of the assembly that faces the fabric netting when the plurality of members are in the closed position.

6. The apparatus of claim 1, wherein the rigid shaping member is attached to the one of the plurality of members via a hinge assembly that is attached to the one of the plurality of members via a snap rivet assembly.

7. The apparatus of claim 1, wherein the at least one aperture includes a plurality of apertures that are a plurality of laser-cut holes.

8. The apparatus of claim 1, wherein the plurality of members are formed from at least one selected from the group of nylon, leather, polyurethane, and combinations thereof.

9. An apparatus for storing golf equipment including a golf glove, comprising:

a first member;

a second member attached to the first member via an attachment portion, the first member and the second member configured to rotate relative to each other about the attachment portion between a closed position forming an interior cavity and an open position;

an organizational assembly attached to the attachment portion or the first member, and configured to rotate about the attachment portion or about a first axis parallel to the attachment portion;

an inflexible shaping member rotatably attached to the second member and configured to rotate about a second axis that is substantially perpendicular to the attachment portion or the first axis; and a plurality of apertures extending through the second member;

wherein the inflexible shaping member is configured to be removably received in the golf glove; and wherein the inflexible shaping member includes a plurality of elongated portions configured to receive portions of the golf glove.

10. The apparatus of claim 9, wherein the inflexible shaping member is rotatably attached to the second member via a hinge assembly that is attached to the second member.

11. The apparatus of claim 10, wherein:

the inflexible shaping member includes an elongated member; and the hinge assembly includes a plurality of protrusions configured to removably, snappably, and rotatably receive the elongated member.

12. The apparatus of claim 9, wherein:

the first member includes a storage pocket disposed in the interior cavity when the first member and the second member are in the closed position; and the organizational assembly includes a plurality of elastic fasteners configured to receive a plurality of pieces of the golf equipment including a golf tee and a divot tool.

13. The apparatus of claim 12, wherein the plurality of elastic fasteners include a plurality of sewn-in magnets configured to receive the golf equipment including metal golf equipment.

14. The apparatus of claim 9, wherein the inflexible shaping member is a hand-shaped member and the plurality of elongated portions are finger-shaped tines configured to receive finger portions of the golf glove.

15. The apparatus of claim 9, wherein the inflexible shaping member is configured to rotate more than 90 degrees about the second axis relative to the second member.

16. The apparatus of claim 9, wherein the inflexible shaping member is configured to be removably received in the golf glove so that the golf glove is rotatable with the inflexible shaping member when the inflexible shaping member is removably received in the golf glove.

17. The apparatus of claim 1, wherein the rigid shaping member is formed from moisture-absorbing material.

18. An apparatus for storing equipment, comprising:

a housing including a plurality of members configured to rotate relative to each other, about an attachment portion of the plurality of members, between a closed position forming an interior cavity and an open position;

an assembly attached to the housing and configured to rotate relative to the housing;

an inflexible shaping member attached to one of the plurality of members and configured to rotate relative to the one of the plurality of members;

at least one aperture extending through the one of the plurality of members; and at least one elastic fastener attached to a surface of the assembly;

wherein the inflexible shaping member is configured to be removably received in the equipment; and wherein the inflexible shaping member includes a plurality of elongated portions configured to receive portions of the equipment, the plurality of elongated portions being rotatable relative to the one of the plurality of members based on the inflexible shaping member being rotatably attached to the one of the plurality of members.

19. The apparatus of claim 18, wherein the equipment includes a golf glove and the plurality of elongated portions are a plurality of tines configured to receive digit portions of the golf glove.

20. The apparatus of claim 18, wherein the inflexible shaping member is formed from moisture-absorbing material.

* * * * *